US008458939B2

(12) United States Patent
Arthur et al.

(10) Patent No.: US 8,458,939 B2
(45) Date of Patent: Jun. 11, 2013

(54) SELF EXPANDING DISPLAY UNIT

(75) Inventors: Jonathan Arthur, Johnstown (IE); Liam McGrath, Arklow (IE)

(73) Assignee: L'Hotel, Francois, Larchant (FR)

( * ) Notice: Subject to any disclaimer, the term of this patent is extended or adjusted under 35 U.S.C. 154(b) by 485 days.

(21) Appl. No.: 12/302,958

(22) PCT Filed: May 30, 2007

(86) PCT No.: PCT/EP2007/055271

§ 371 (c)(1),
(2), (4) Date: Nov. 4, 2009

(87) PCT Pub. No.: WO2007/138083

PCT Pub. Date: Dec. 6, 2007

(65) Prior Publication Data

US 2010/0043261 A1 Feb. 25, 2010

(30) Foreign Application Priority Data

May 30, 2006 (IE) ..... S2006/0411
Apr. 5, 2007 (IE) ..... S2007/0244
Apr. 17, 2007 (IE) ..... S2007/0279

(51) Int. Cl.
*G09F 15/00* (2006.01)

(52) U.S. Cl.
USPC ..... 40/610; 40/539

(58) Field of Classification Search
USPC ..... 40/610, 124.08, 539
See application file for complete search history.

(56) References Cited

U.S. PATENT DOCUMENTS

| | | | | |
|---|---|---|---|---|
| 1,545,771 | A * | 7/1925 | Hout | 229/107 |
| 2,160,724 | A * | 5/1939 | Fletcher | 40/603 |
| 6,347,772 | B1 * | 2/2002 | L'Hotel | 248/174 |
| 6,508,023 | B2 * | 1/2003 | Moss et al. | 40/610 |
| 7,134,230 | B1 * | 11/2006 | Boens et al. | 40/610 |
| 2002/0171023 | A1 * | 11/2002 | L'Hotel | 248/560 |
| 2006/0038393 | A1 * | 2/2006 | Sgambellone | 281/15.1 |

* cited by examiner

*Primary Examiner* — Joanne Silbermann
*Assistant Examiner* — Kristina Junge
(74) *Attorney, Agent, or Firm* — Brian J. Colandreo; Holland & Knight LLP; Michael T. Abramson

(57) ABSTRACT

A self-expanding display unit (1) comprising at least one display sheet (3, 5) of a substantially rigid and foldable material having a display face (7,9), a biasing means for bending the display face of the display sheet into a substantially convex shape, and bracing means (2) acting against the biasing means to limit the amount by which the display sheet (3, 5) bends. The display sheet comprises a plurality of panels, delimited from adjacent panels by crease lines. The bracing means (2) comprises a single, substantially rigid and foldable bracing sheet (2) having a plurality of bracing panels (50), each of which is delimited from an adjacent bracing panel by a fold line (52). The fold lines (52) and the crease lines are coincident with each other. Such a device is stable in operation and is efficient to use and manufacture.

25 Claims, 22 Drawing Sheets

SELF EXPANDING DISPLAY UNIT

RELATED APPLICATIONS

The subject application is a U.S. National Stage application that claims the priority of International Application No. PCT/EP2007/055271, filed on 30 May 2007, which claims the priority of Irish National Application Nos.: S2007/0279, filed on 17 Apr. 2007, S2007/0244, filed on 5 Apr. 2007, and S2006/0411, filed on 30 May 2006.

The present invention relates to a self-expanding display unit comprising at least one display sheet of a substantially rigid and foldable material, the display sheet having a display face, a biasing means for bending the display face of the display sheet into a substantially convex shape, the biasing means comprising one or more resiliently extensible members, and bracing means acting against the biasing means to limit the amount by which the display sheet bends. The display sheet comprises a plurality of panels, delimited from adjacent panels by crease lines. Such devices are commonly used as information displays in many areas of business, such as retail and marketing.

Self-expanding display units are directed towards satisfying a demand for temporary information displays. Such temporary information displays are typically used in retail locations as part of temporary promotional displays, such as those used to promote a new product or special offer. Similarly, temporary information displays are used at sales fairs, conferences and other situations where temporary, promotional signage is required. For these situations, marketing and sales personnel require temporary information displays that can be easily transported, easily set-up and that are relatively inexpensive. In order to satisfy these requirements, a number of display units constructed from cardboard, have been developed. Cardboard is lightweight, portable, inexpensive and, while quite rigid, can also be easily folded. This ability to be folded is very useful as it allows the display units to be folded substantially flat to a more compact shape and reduced size when not in use.

Typically, the temporary display units have a number of elastic bands that are arranged to cause the temporary display unit to maintain a particular shape when set up. Furthermore, the elastic bands are usually arranged to help the display unit self-expand from a folded, stored configuration to an expanded, operating configuration. The use of elastic bands allows the display units to be stored in a relatively flat state, thus stretching the elastic bands so that when the display unit is released from its folded position, the elastic bands relax and pull the cardboard display unit into the desired shape. When in use, the display unit can be a self-supporting three dimensional shape that does not require much adjustment once it has been set-up.

One such construction of foldable display unit is that disclosed in EP1395971 (l'Hotel, François). This construction of foldable display unit comprises a display sheet connected to a plurality of smaller sheets or strips by way of a number of elastic bands. The display sheet bends under the action of the elastic bands until its edges abut against the edges of the strips. Thus the combination of the strips and elastic bands hold the display sheet in the bent position when the unit is in use. In this way the unit can take on a three dimensional shape when in use, and is somewhat self-supporting, generally with the use of one or more additional ground-engaging feet. The supporting strips are rigid and are not designed to be folded and therefore must be carefully positioned relative to the display sheet so as not to interfere with the folding of the unit. The display sheet comprises a number of crease lines, about which the unit folds when it is not in use. These crease lines define panels intermediate the crease lines. The supporting strips are placed so that they are positioned directly behind the panels. This ensures that the supporting strips are positioned away from the folding areas of the display unit, as defined by the crease lines. In this way, the supporting strips will not hinder the folding of the unit in any way.

While much effort has gone into the development of display units that are easily transported, easily set-up and relatively inexpensive to produce, there are some problems associated with the temporary display units in general. First of all, the manufacturing process can be relatively complex. The requirements that the display unit has means to keep the display sheet bent and that those means do not interfere with the folding of the display unit has heretofore meant that many individual elements were required to construct the display unit. The manufacture of the display unit therefore entails manufacture of a large number of pieces and their subsequent assembly. This can be a time-consuming and intricate operation to perform.

A further problem with the known display units is that many of the known types of display units are relatively unstable. The combination of one or two display sheets and a number of strips does not always provide a sufficiently stable body and it is necessary to provide additional ground-engaging supports or feet to ensure the unit remains upright when in use. Such ground-engaging supports further complicate the manufacturing process and can also cause difficulties when a user comes to erect the display unit.

It is an object therefore of the present invention to provide a self-expanding display unit that is simple to manufacture and construct. It is a further object of the invention to provide a self-expanding display unit that is stable in use.

STATEMENTS OF INVENTION

According to the invention there is provided a self-expanding display unit comprising at least one display sheet of a substantially rigid and foldable material, the display sheet having a display face; a biasing means for bending the display face of the display sheet into a substantially convex shape, the biasing means comprising one or more resiliently extensible members; and bracing means acting against the biasing means to limit the amount by which the display sheet bends, the display sheet comprising a plurality of panels, delimited from adjacent panels by crease lines characterised in that the bracing means comprises a single, substantially rigid and foldable bracing sheet having a plurality of bracing panels, each of which is delimited from an adjacent bracing panel by a fold line, the bracing sheet being positioned relative to the display sheet such that each fold line of the bracing sheet is coincident with a crease line of the display sheet; the display sheet and the bracing sheet being foldable together at their crease lines and fold lines respectively.

In this way, the display unit will comprise a small number of components, thereby greatly reducing the machining required in the manufacture of the display unit. Furthermore, reducing the number of components also reduces the time and complexity involved in assembling the components into the final structure. As the bracing means comprise a single component, it is a relatively simple matter to connect the bracing means and the display sheet together by way of the biasing means. Additionally, the use of a single bracing sheet will assist in the self-expanding action of the display unit. This is due in part to the extra layer of material present at each fold when which will result in an increased bias towards an unfolded state at each fold. Furthermore, it is believed that the biasing means acting on the bracing sheet will cause a force to act against not only the bracing panel to which it is connected but also to the adjacent bracing panels, thereby increasing the self-expanding action. This results in a display unit that is easier to expand from a folded configuration.

In one embodiment of the invention there is provided a self-expanding display unit in which the bracing sheet has an upper end, a lower end and two side edges, the lower end of the bracing sheet being coincident with a lower end of the display sheet such that the lower end of the bracing sheet and the lower end of the display sheet each form a ground-engaging support for the display unit. The provision of at least two ground-engaging members, in the form of the lower end of the display sheet and the lower end of the bracing sheet, provides improved stability to the display unit when it is in use.

In another embodiment of the invention there is provided a self-expanding display unit in which each bracing panel of the bracing sheet comprises at least one aperture for connecting the biasing means to the bracing sheet. This is a simple and efficient manner of providing for the connection of the biasing means to the bracing panel.

In one embodiment of the invention there is provided a self-expanding display unit in which each bracing panel of the bracing sheet comprises a plurality of apertures located at the side edges of the bracing sheet for connecting the biasing means to the bracing sheet. In this way, the apertures do not extend greatly into the sides of the bracing panels thereby allowing areas at the centre of the panels to be cut out without impeding the operation of the display unit. The cut out areas may then be used to accommodate the fitting of inserts such as shelving units or the like.

In another embodiment of the invention there is provided a self-expanding display unit in which the apertures comprise a narrow cut extending inwardly from the edge of the sheet and terminating in a circular aperture. In this way, the biasing means may be slid through the narrow cut to sit in the circular aperture. The circular aperture is particularly advantageous as the biasing means may exert a pull on the aperture and it is less likely to tear under normal operating conditions.

In a further embodiment of the invention there is provided a self-expanding display unit in which each bracing panel of the bracing sheet comprises a pair of crescent-shaped apertures for connecting the biasing means to the bracing sheet. This is a particularly effective way of providing for the connection of the bracing sheet to the biasing means. Additionally, the crescent-shaped cut-outs reduce the chance of the biasing means tearing the bracing sheet during the day to day operation of the display unit.

In a further embodiment of the invention there is provided a self-expanding display unit in which the bracing sheet comprises a further panel, forming a ground-engaging panel, which extends from the lower end of the bracing sheet and is delimited from the bracing panel adjacent the lower end of the bracing panel by a fold line. In this way, the ground-engaging panel will extend below the display sheet and in use, will rest flat on the ground, substantially orthogonal to the bracing sheet. The lower end of the display sheet will therefore rest on the ground-engaging panel while the display unit is in use. The ground-engaging panel will provide an increased footprint for the display unit, thereby providing increased stability.

In an alternative embodiment of the invention there is provided a self-expanding display unit in which the ground engaging panel is substantially semi-elliptical in shape. In this way, the shape of the ground-engaging panel will mirror the shape of the display faces when the display unit is in use.

In one embodiment of the invention there is provided a self-expanding display unit in which the ground-engaging panel is substantially the same width as the display face. In this way, the display unit comprising the ground-engaging panel will still fold in a compact manner and the size of the folded display unit will not increase.

In another embodiment of the invention there is provided a self-expanding display unit in which the bracing sheet comprises a pair of ground-engaging panels, both extending from the lower end of the bracing sheet. In this way, a further increased footprint may be provided to the display unit, thereby increasing stability. Additionally, the ground-engaging panels preferably extend below the display unit in opposite directions, again increasing the footprint of the unit and increasing stability.

In a further embodiment of the invention there is provided a self-expanding display unit in which the area of the bracing panel adjacent the upper end of the bracing sheet is less than that of the other bracing panels of the bracing sheet. This reduces the amount of material required to form the bracing sheet, reducing the cost of materials used in the manufacture of the display unit. Furthermore, as the uppermost panel of the bracing sheet is not as large as the other panels, it will not reach the top of the display sheet and will be less likely to be seen when looking at the upper panel of the display sheet. This configuration of bracing sheet is therefore more aesthetically pleasing than a bracing sheet having a full size upper panel. Additionally, it may be possible to use the spare material omitted from the uppermost panel of the bracing sheet elsewhere in the manufacture of the display unit. Finally, by reducing the weight of the bracing panel adjacent the top of the display unit, the display unit will have a greater proportion of its weight located lower down thereby providing a more stable display unit.

In one embodiment of the invention there is provided a self-expanding display unit in which each panel of the display sheet is delimited from an adjacent panel by a pair of spaced-apart substantially parallel crease lines. In a further embodiment each bracing panel of the foldable bracing sheet is delimited from an adjacent bracing panel by a pair of spaced-apart substantially parallel fold lines. In this way, simple and convenient folding of the display unit may be facilitated. Due to the inherent thickness and rigidity of the material, a fold where the material will completely double back on itself i.e. a 180° fold is better accommodated by two crease lines, essentially allowing two folds, each of approximately 90°. Additionally, as there are at least two layers of the substantially rigid and foldable material used to form the bracing and display sheets present at each fold, the fold will have a certain width associated with it and a certain amount of space is required to accommodate this material at the fold. This space is advantageously provided by using two, slightly spaced-apart crease lines at each fold. This presence of the pair of slightly spaced apart crease lines gives a squared edge to the fold when the display unit is in the folded, storage configuration, which allows the display unit to fold in a more compact manner.

In a further embodiment of the invention there is provided a self-expanding display unit in which the bracing sheet has a tab along one side edge thereof for engagement with a complimentary slot formed in the display sheet to limit relative movement therebetween. Ideally, there are provided a pair of tabs and a pair of complimentary slots, the tabs being located adjacent the lower end of the bracing sheet. The use of a tab and complimentary slot allows the position of the bracing sheet relative to the display sheet to be substantially fixed. The presence of the tab in the slot prevents longitudinal movement of the bracing sheet relative to the display sheet. This ensures that the crease lines of the bracing sheet will always be coincident with the fold lines of the display sheet, allowing the easy folding of the display unit when required. Furthermore, placing the tabs adjacent the lower end of the bracing sheet allows them to be less visible than if they were higher up the bracing sheet.

In an alternative embodiment of the invention there is provided a self-expanding display unit in which the display face has at least two edges, substantially vertical in use, and the slots are formed therein. In this way, the tabs and slots do not interfere with the main area of the display face, thereby allowing information to be printed easily on the display face and maximising the effectiveness of this information.

In one embodiment of the invention there is provided a self-expanding display unit in which there are two pairs of slots, one pair adjacent an upper end of the display sheet and the other pair adjacent the lower end of the display sheet. This facilitates ease of assembly of the display unit as the display sheet does not have a top or bottom section until the bracing sheet has been fitted. The display sheet is symmetrical and can have the bracing sheet fitted with the tabs at either end. Furthermore, when in use, the spare pair of slots may be used to support additional elements such as a holder for leaflets or other such material. In some cases, one pair or slots may be particularly adapted to facilitate fitting additional parts to the display unit.

In another embodiment of the invention there is provided a self-expanding display unit in which there are provided a pair of display sheets each having a display face and a plurality of panels delimited from an adjacent panel by crease lines, the display sheets being connected together adjacent the side edges thereof with their display faces back-to-back, the display sheets thereby, in use, forming a structure substantially elliptical in horizontal cross-section, the crease lines of the first display sheet being coincident with the crease lines of the second display sheet. In this way, a versatile display unit is provided, having two displays faces, both of which may have promotional content or the like printed thereon. Additionally, the provision of an additional display sheet provides an additional ground engaging member, thereby increasing the stability of the display unit.

Furthermore, a display unit of this construction will be substantially symmetrical about a vertical axis, thereby increasing its usefulness and stability.

DETAILED DESCRIPTION OF THE INVENTION

The invention will now be more clearly understood from the following description of some embodiments thereof, given by way of example only, with reference to the accompanying drawings in which.

Figure 1:
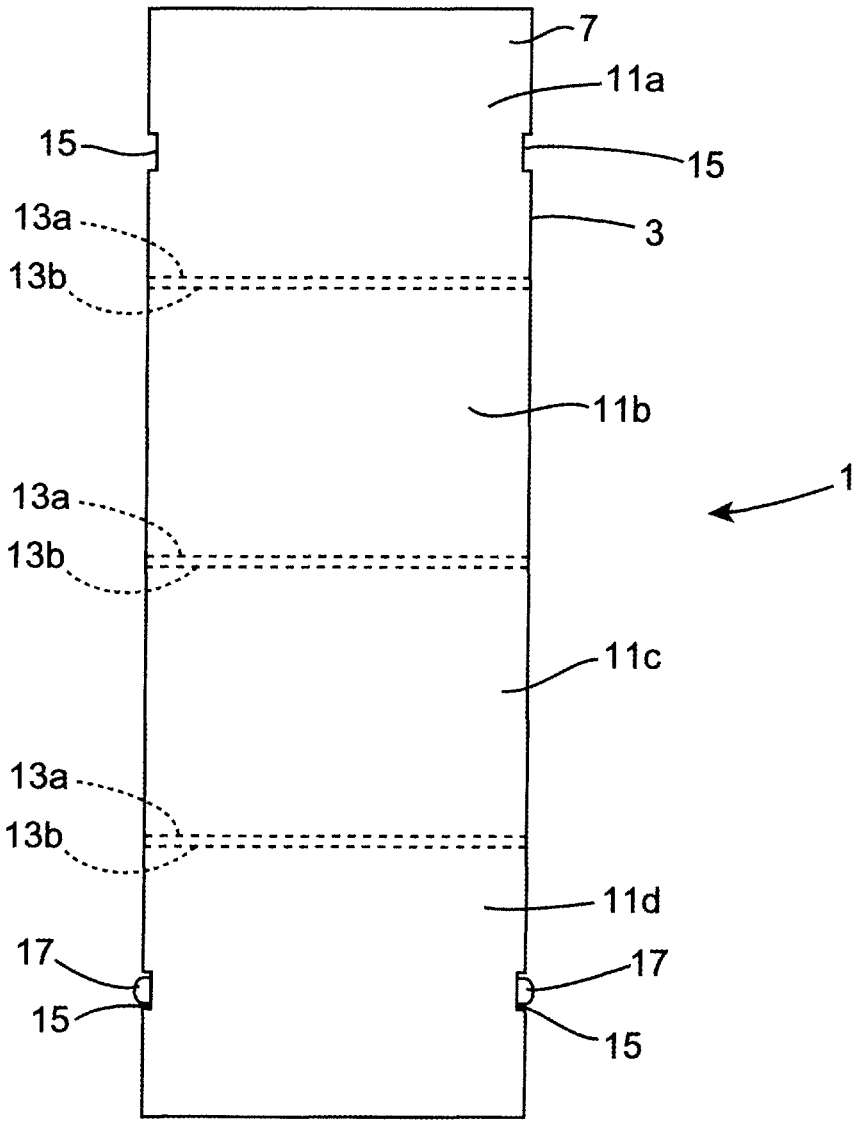
FIG. 1 is a front view of a self-expanding display unit according to the invention in an operating configuration.
Figure 2:
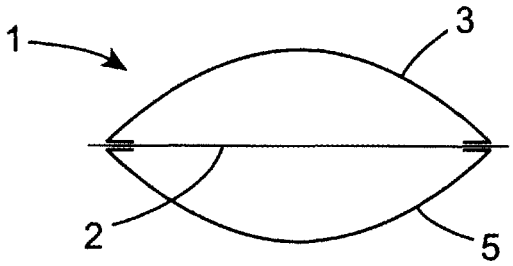
FIG. 2 is top plan view of the display unit shown in FIG. 1.
Figure 3:
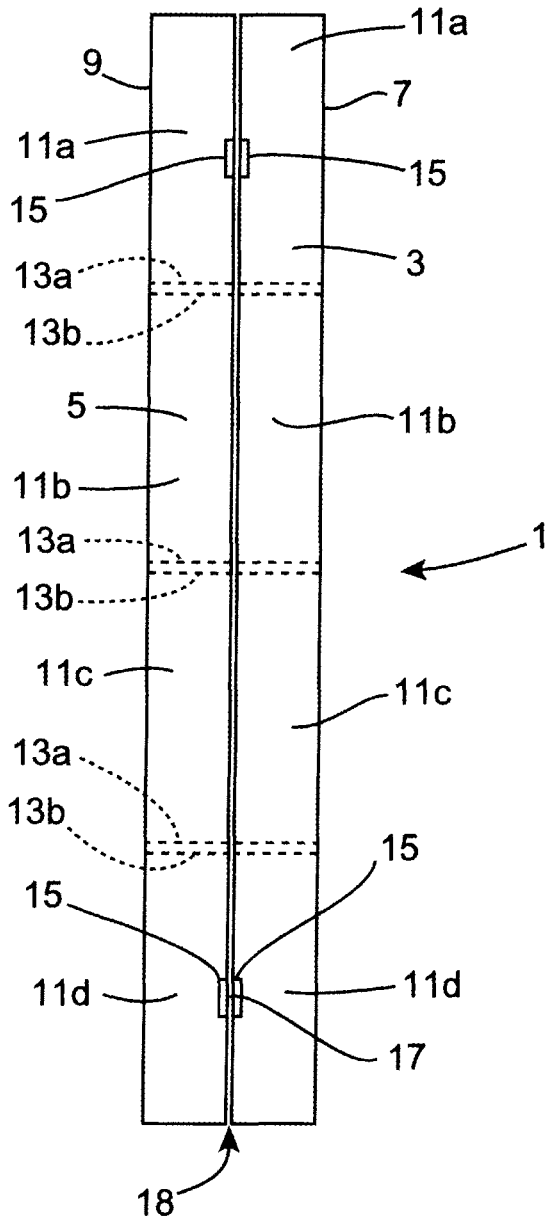
FIG. 3 is a side view of the display unit.

Referring to the drawings, and initially to FIGS. 1 to 3 thereof, there is shown a display unit, indicated generally by the reference numeral 1, comprising an elongate bracing sheet (not shown) and a pair of elongate display sheets 3, 5, each having a display face 7, 9. Each display sheet 3, 5 is divided into four panels 11*a*, 11*b*, 11*c*, 11*d* by pairs of crease lines 13*a*, 13*b* (shown as dashed lines). The crease lines 13*a*, 13*b* are formed during the manufacture of the display unit 1, and allow the substantially rigid material used to construct the display unit to fold easily at those lines. At each longitudinal edge of each display face, there is provided a pair of slots 15, one slot in the uppermost panel 11*a* and one in the lowermost panel 11*d*. Each of the slots 15 in the lowermost panel 11*d* engage with one of a pair of complimentary tabs 17 on the bracing sheet. Therefore, the bracing sheet 2 may be connected to the display sheet 3 so that tabs 17 engage slots 15 on the uppermost panel 11*a* or on the lowermost panel 11*d*.

Figure 4:
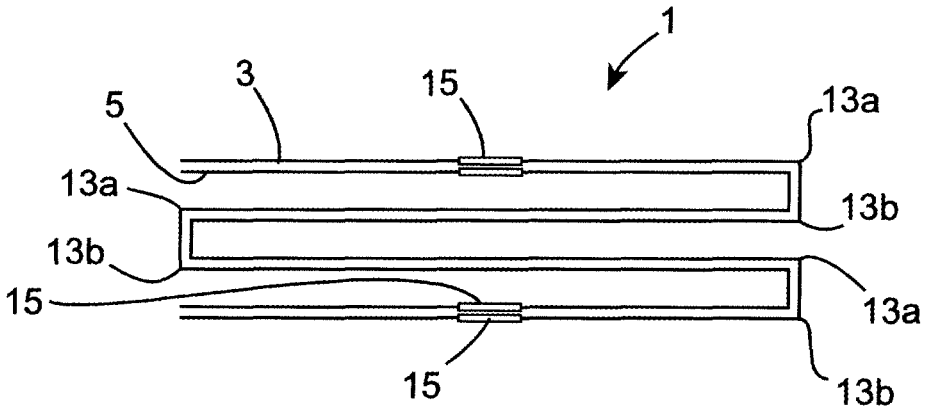
FIG. 4 is a side view of the display unit in a storage configuration.

Referring now to FIG. 4, there is shown a diagrammatic representation of the display unit 1 when folded. It can be seen that when folded the display unit 1 takes on a substantially serpentine shape, with the pairs of crease lines 13*a*, 13*b* defining the area where the display unit 1 folds. The display unit will fold through substantially 180° at each pair of crease lines 13*a*, 13*b* such that the panels 11*a*, 11*b*, 11*c*, 11*d* will lie substantially parallel to each other, one on top of the other. The 180° fold comprises a combination of two 90° folds, one fold at each crease line 13*a*, 13*b*.

Figure 5:
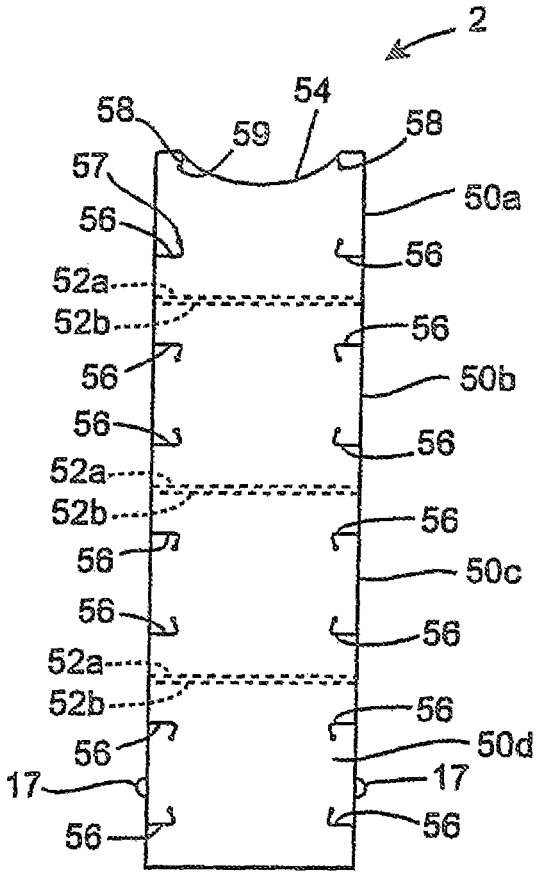
FIG. 5 is a front view of the bracing sheet.

Referring now to FIG. 5, there is shown the elongate bracing sheet 2, having four bracing panels 50*a*, 50*b*, 50*c*, 50*d* delimited by pairs of fold lines 52*a*, 52*b*. The bracing sheet is not shown to scale. The fold lines are formed during the manufacture of the display unit 1, and allow the substantially rigid material used to construct the display unit to fold easily at those lines. The top panel 50*a* is smaller in area than the remaining panels and has an arcuate cut 54 in its top edge. Each of the lower bracing panels 50*b*, 50*c*, 50*d* has a plurality of apertures 56 in their edges for connection to the display sheets by elastic bands (not shown). The top panel 50*a* has two standard apertures 56 in the side edge and two smaller apertures 58 in the top edge. The bracing sheet 2 56, 58 therefore comprises sixteen apertures, seven in each side and two in the top. Each rectangular bracing panel 50*b*, 50*c*, 50*d* comprises four standard apertures 56, two in each side. The standard apertures 56 take the form of a thin cut in the material of the bracing sheet, the thin cut having a straight portion extending inwardly from the edge and substantially orthogonal thereto, and a curved portion extending from the straight portion in a substantially hook shape. The standard aperture 56 then terminates in a substantially circular portion 57, in which the elastic band (not shown) will sit when fitted.

For each of the rectangular bracing sheets 50*b*, 50*c*, 50*d*, on each side the curved portions of the two standard apertures 56 curve towards each other in that the upper aperture in a standard bracing panel curves downward and the lower aperture curves upwards. The smaller apertures 58 take the form of a thin cut having a straight portion extending inwardly from the edge and substantially orthogonal thereto which terminates in a substantially circular portion 59 in which the elastic band will sit. The bottom panel 50*d* of the bracing sheet 2 has a pair of tabs 17 for engagement with the slots 15 on the display sheets 3, 5. It will be understood that the straight and curved portions of these apertures 56, 58 may comprise a simple cut in the material of the bracing panel and will therefore have no substantial width. Alternatively, these portions may comprise cut-out portions having a narrow width of the order of 2 to 5 mm, preferably between 3 mm and 5 mm. The substantially circular portions 57, 59 will comprise a cut-out shape.

Figure 6:
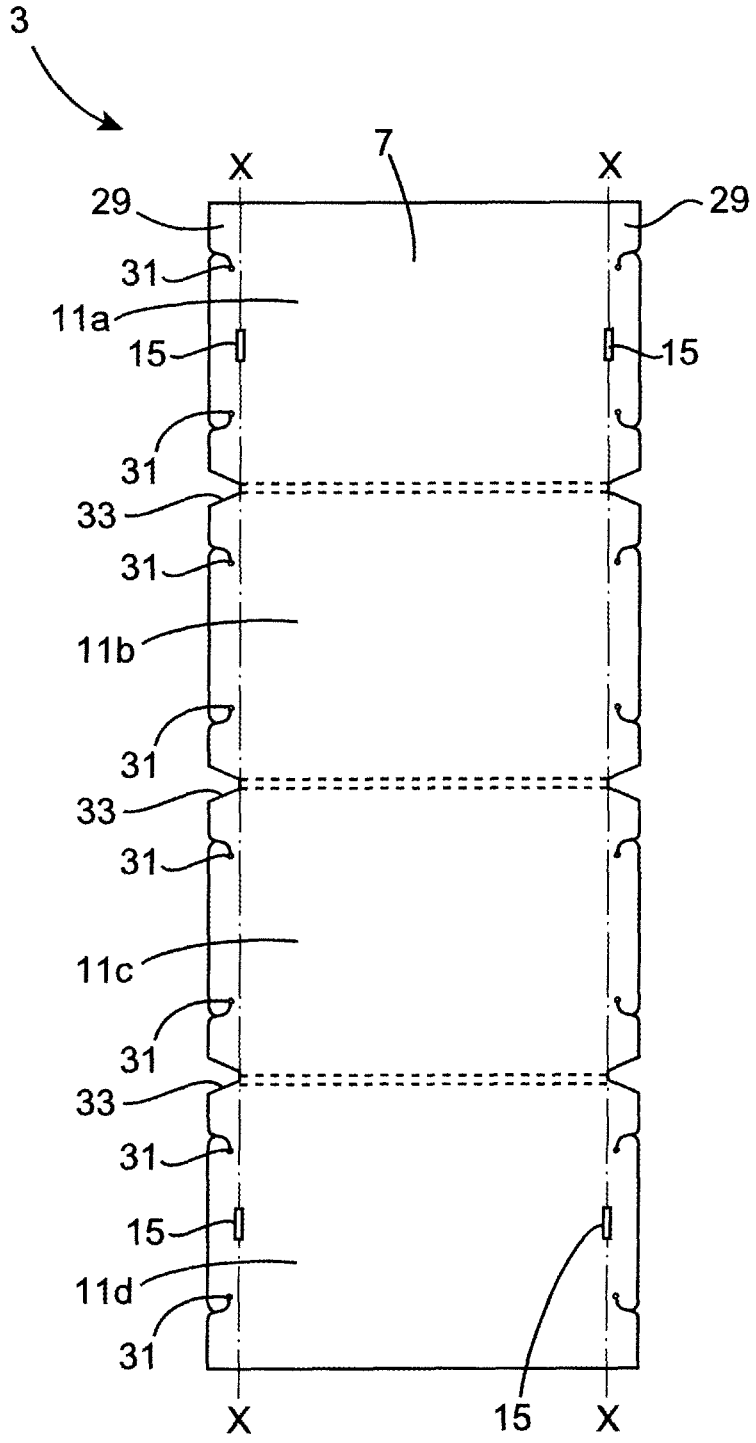
FIG. 6 is a front view of a display sheet.

Referring now to FIG. 6, there is shown a drawing of one elongate display sheet, indicated generally by the reference numeral 3, wherein like parts have been given the same numerals as before. Each display sheet 3 comprises four panels 11*a*, 11*b*, 11*c*, 11*d* and has an elongate display face 7 and a pair of flaps 29 at the side edges of the display sheet 3. The flaps 29 have a plurality of notches 31 therein for engagement with elastic bands (not shown) thereby allowing the display sheet 3 to be connected to the bracing sheet 2 and another display sheet. The notches 31 comprise a thin cut curving from the outside edge of the flap and terminating in a circular portion, in which the elastic band (not shown) will sit when fitted. Each panel 11*a*, 11*b*, 11*c*, 11*d* of the display sheet 3 comprises four notches, two on each side. The curve of each notch forms a semi-circle, with the upper notch in a panel initially curving upwards from the outside edge of the flap 29 before curving downwards and terminating in the circular portion, while the lower notch curves downwards initially from the outside edge of the flap and then curves upwards before terminating in the circular portion. The flaps 29 also have Vee-shaped notches 33 at the crease lines 13*a*, 13*b* to facilitate folding at these areas. The display face of the display sheet is wider than the bracing sheet.

Figure 7:
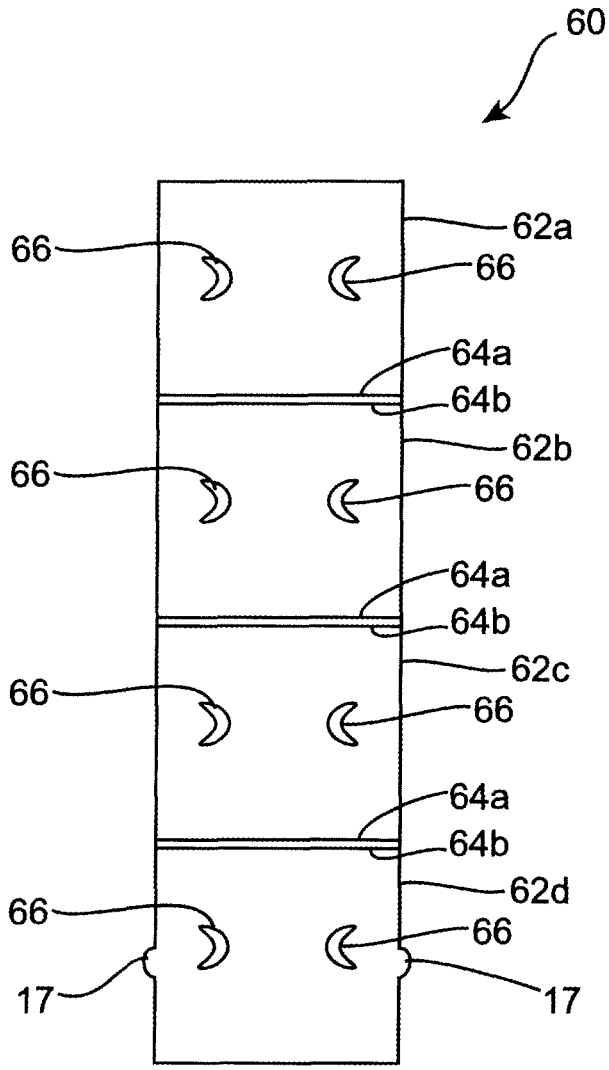
FIG. 7 is a front view of an alternative embodiment of bracing sheet.

Referring now to FIG. 7, there is shown an alternative embodiment of an elongate bracing sheet indicated generally by the reference numeral 60, having four bracing panels 62*a*, 62*b*, 62*c*, 62*d* delimited by pairs of fold lines 64, 64*b*. The fold lines are formed during the manufacture of the display unit 1, and allow the substantially rigid material used to construct the display unit to fold easily at those lines. Each of the bracing panels 62*a*, 62*b*, 62*c*, 62*d* has a pair of crescent-shaped cut-outs 66 for engagement with elastic bands (not shown) thereby allowing the bracing sheet 60 to be connected to the display sheets 3, 5. The points of the crescent-shaped cut-outs 66 face the edges of the bracing sheet 60 and effectively form notches for the reception of the elastic bands. The bottom panel 62*d* of the bracing sheet 60 has a pair of semi-circular tabs 17 for engagement with the corresponding slots 15 on the display sheets 3, 5.

To assemble the self-expanding display unit 1 of the invention, the flaps 29 of each display sheet 3, 5 are folded back on themselves along the lines marked X-X and the two display sheets 3, 5 and the bracing sheet 2, 60 are connected together using elastic bands (not shown) so that the flaps 29 of one display sheet 3 abut the flaps on the other display sheet 5, with the display faces 7, 9 facing outwards. The elastic bands will be connected between the notches 31 of the display sheets 3,5 and the apertures 56, 58, or crescent shaped cut-outs 66 of the bracing sheet 2, 60. In general, two elastic bands (not shown), one at each side, will be used to connect a bracing panel 50, 62 of the bracing sheet 2, 60 to the corresponding panels 11 of the two display sheets 3, 5. The elastic bands (not shown) are chosen such that they will be slightly stretched when the display sheets and bracing sheets are lying flat against each other in a stored configuration. Therefore, a single elastic band will be looped through the pair of notches 31 nearest a bracing panel and the elastic band will then be looped through the two apertures 56 (or 56 and 58 for the top panel) or the crescent 66 of the bracing panel adjacent the notches 31. Another elastic band will be provided along the other edge of the bracing panel to engage the notches and apertures nearest the other edge of the bracing panel. Each bracing panel will have a pair of elastic bands, one along either edge of the bracing sheet.

In use, when no external force is exerted on the display unit 1, the elastic bands, which are slightly stretched, will attempt to contract to their resting shape. In doing so they will pull the edges of the display sheets inwards until they abut the edges of the bracing sheet. At this point the elastic bands can contract no further, as the movement of the display sheets is limited by the bracing sheet. As the edges of display sheets 3, 5 are pulled inwards, the display faces 7, 9 of display sheets 3, 5 are forced into a convex shape thereby forming a structure having a substantially elliptical horizontal cross-section. In order to store the display unit, the unit may be collapsed inwardly by pressing on the display faces 7, 9 so that the elastic bands (not shown) are stretched once more and the display sheets 3, 5 are flattened against the bracing sheet 2. The display unit 1 may now be folded about the crease lines 13*a*, 13*b* into the substantially serpentine shape shown in FIG. 4. Depending on the force of the elastic bands and the weight of the material used to construct the bracing and display sheet, the display unit may require some form of constraint to keep it folded, however, the weight of the materials in the display unit may be sufficient to keep the device folded. To expand the device, it suffices to hold onto the side edges of one of the upper panels of the display unit and lift it off the ground. The elastic bands will contract once more, bending the display sheets to create a self-supporting display unit.

Figure 8:
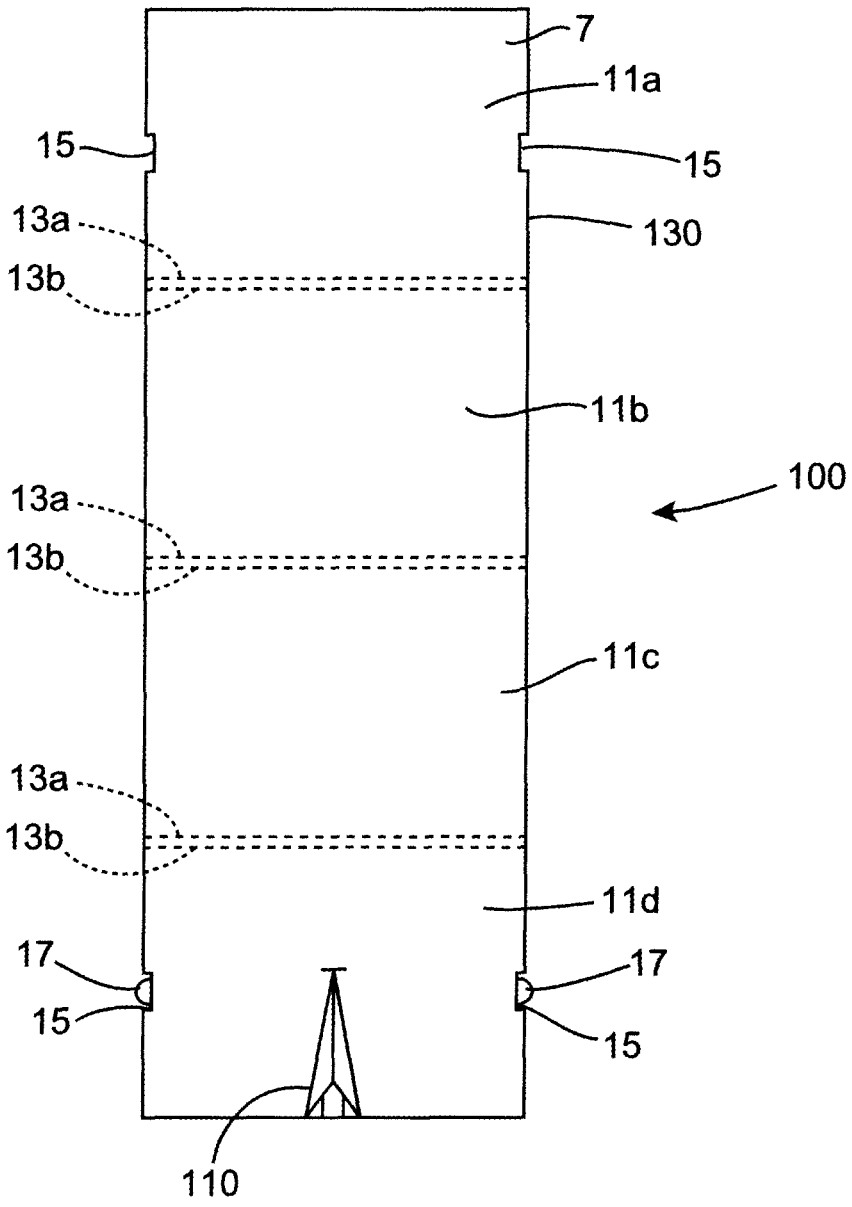
FIG. 8 is a front view of an alternative embodiment of a self-expanding display unit according to the invention in an operating configuration.
Figure 9:
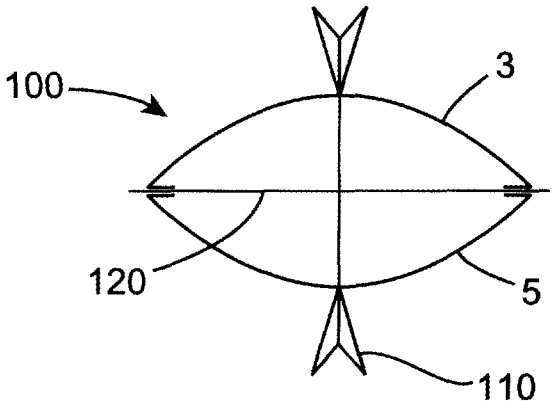
FIG. 9 is top plan view of the display unit shown in FIG. 8.
Figure 10:
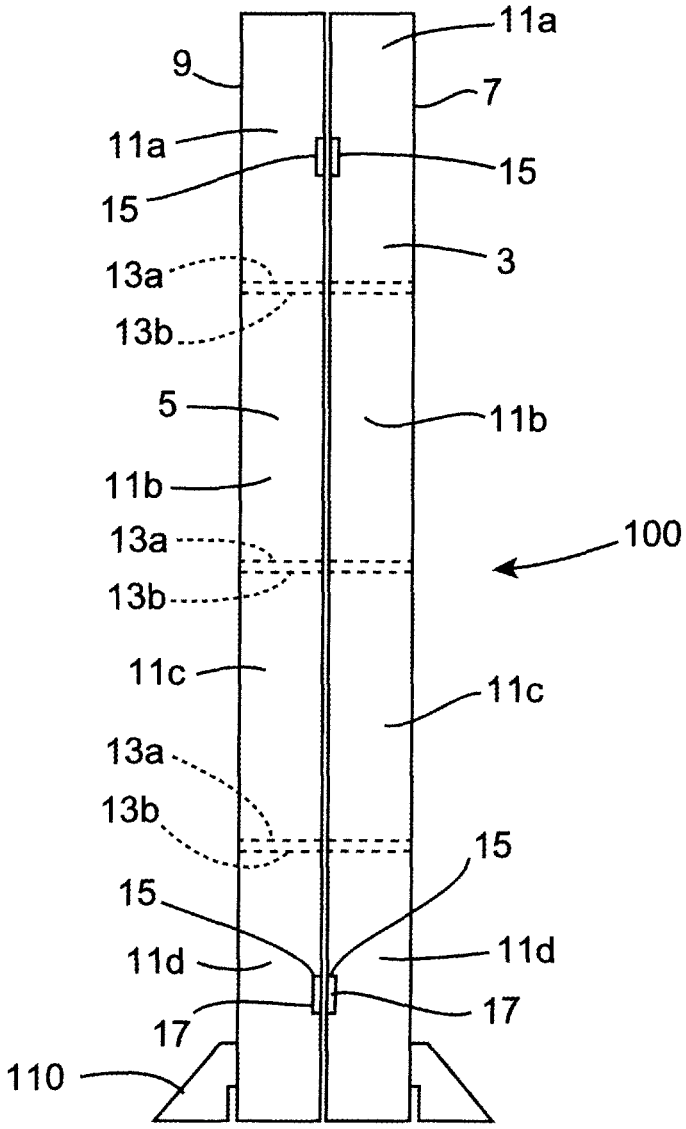
FIG. 10 is a side view of the display unit in FIG. 8.
Figure 11:
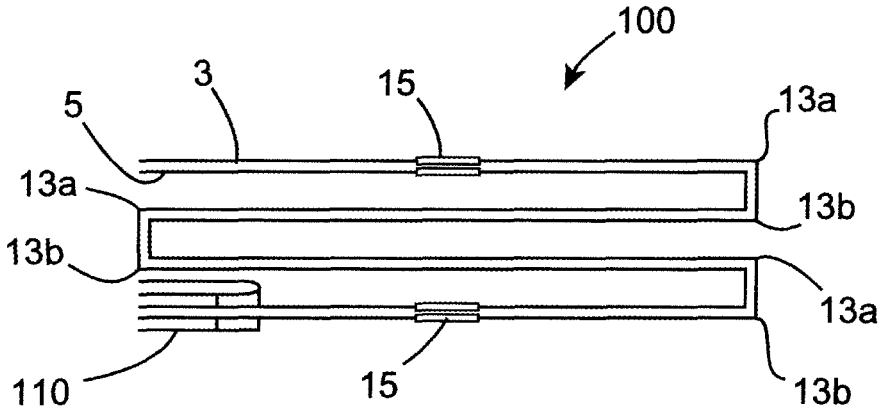
FIG. 11 is a side view of the display unit in FIG. 8 in a storage configuration.
Figure 12:
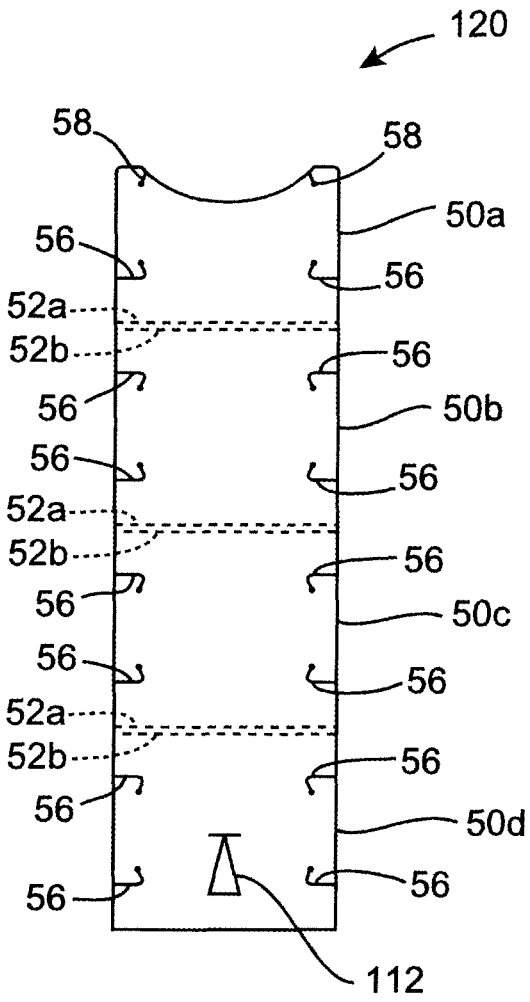
FIG. 12 is a front view of the bracing sheet used in the display unit of FIG. 8.
Figure 13:
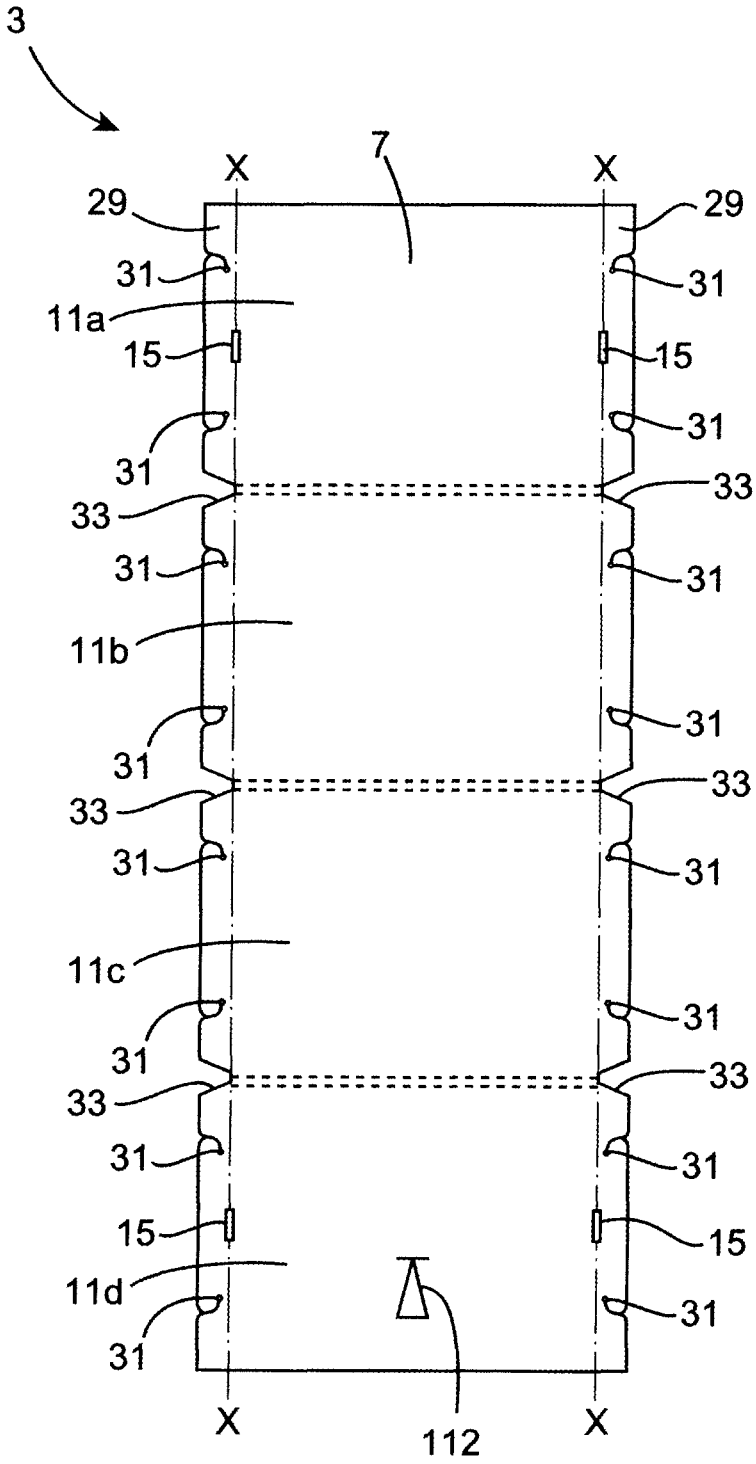
FIG. 13 is a front view of a display sheet used in the display unit of FIG. 8.
Figure 14:
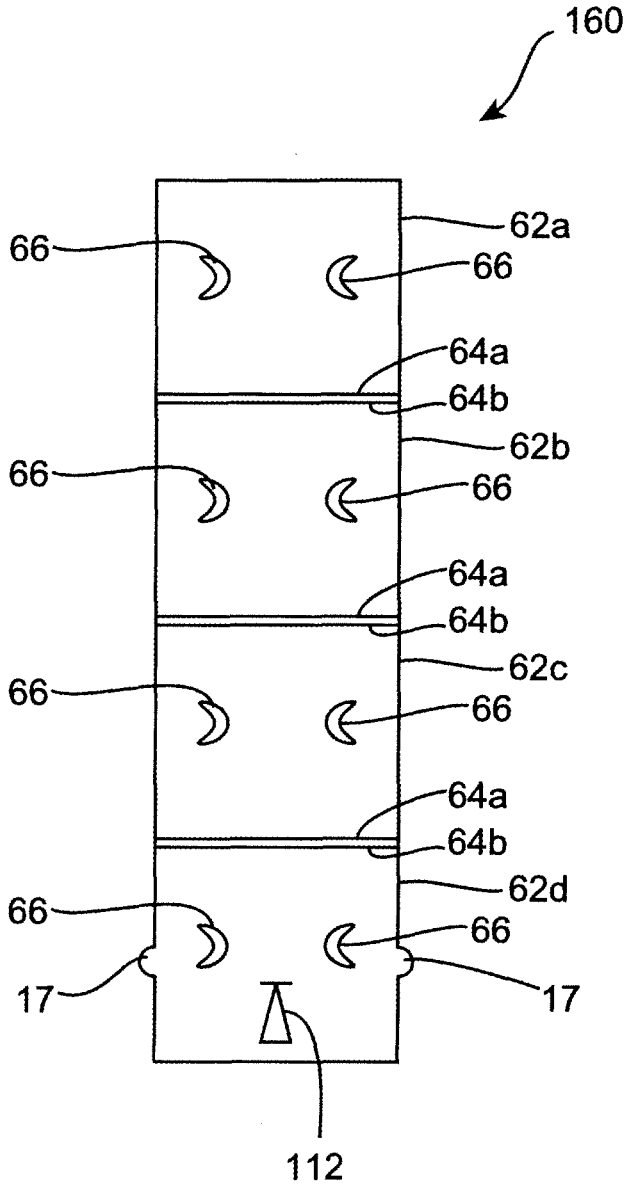
FIG. 14 is a front view of an alternative embodiment of bracing sheet to be used in the display unit of FIG. 8.

Referring now to FIGS. 8 to 14, there is shown an alternative embodiment of the display unit in which like parts have been the same reference numerals as before. Referring initially to FIGS. 8 to 10 there is shown a display unit indicated generally by the reference numeral 100 comprising an elongate bracing sheet 120, a pair of elongate display sheets 3, 5 each having a display face 7, 9 respectively. The display unit 100 further comprises a ground-engaging foot 110. The ground engaging foot 110 is shown being substantially a trapezium shape having a section removed from its base. The ground engaging foot is fitted through slots 112 in each display sheet 3, 5 and bracing sheet 120, 160 such that its base will rest on the ground when the display unit 100 is in use. The slot 112 is substantially triangular in shape, tapering towards its upper end and has a horizontal slit at its apex and the slots in each display sheet and bracing sheet will be aligned such that the ground engaging foot 110 will be oriented substantially orthogonally to the bracing sheet 120, 160 in use. The ground-engaging foot 110 lies flat against the display faces 130, 150 of the display unit 100 when the display unit 100 is in its folded storage configuration. It is envisaged that a number of slots 112 and ground engaging feet 110 may be provided if desired. Preferably, these would be spaced evenly across the width of the display sheet and bracing sheet. For example, two or three feet may be provided if desired.

Figure 15:
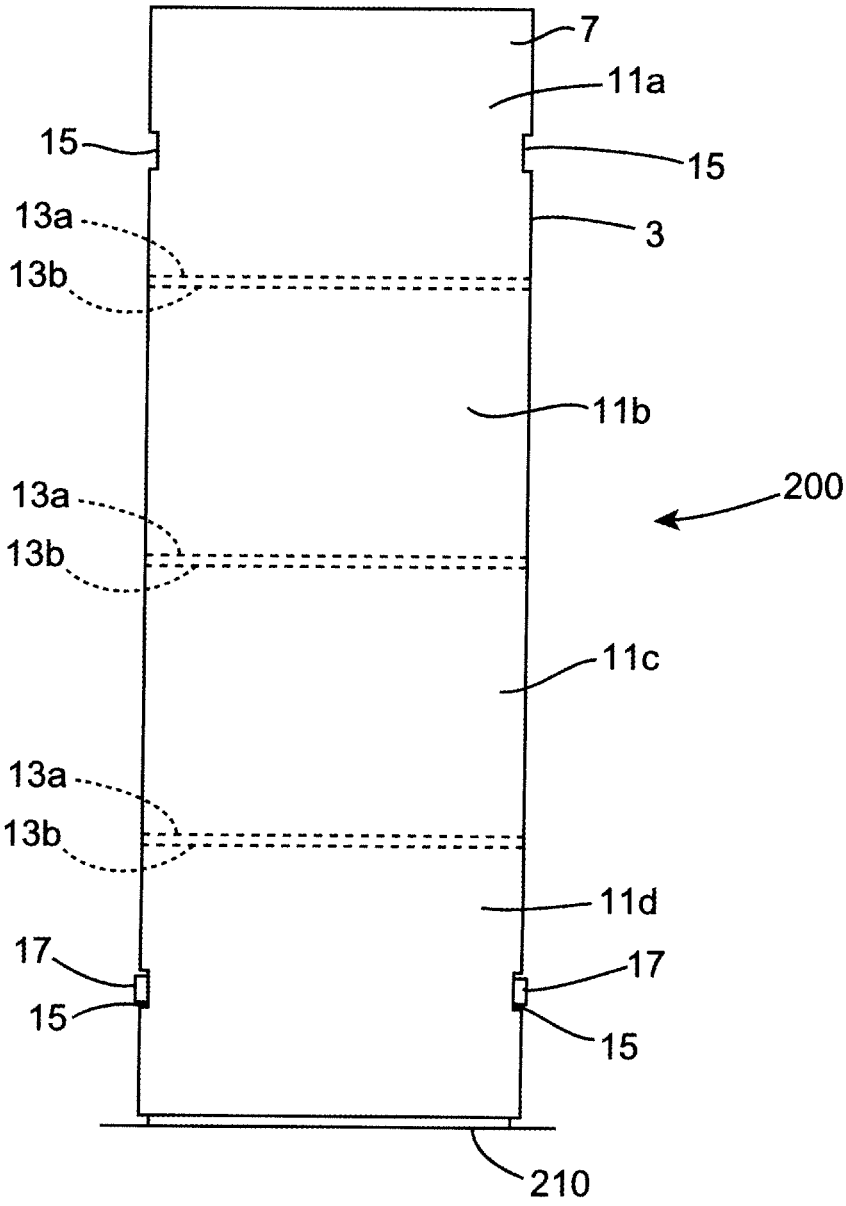
FIG. 15 is a front view of an alternative embodiment of a self-expanding display unit according to the invention in an operating configuration.
Figure 16:
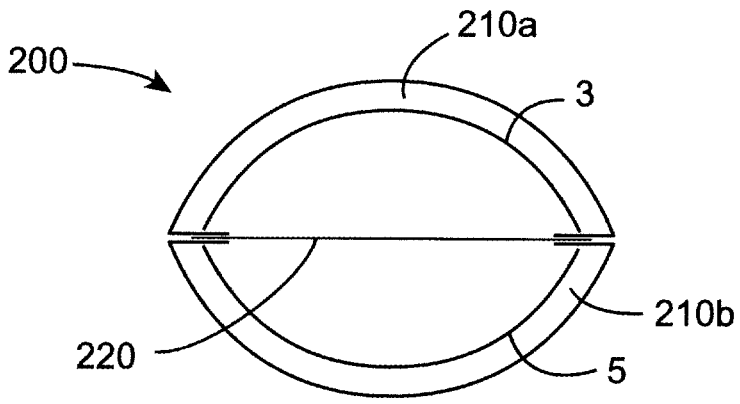
FIG. 16 is top plan view of the display unit shown in FIG. 15.
Figure 17:
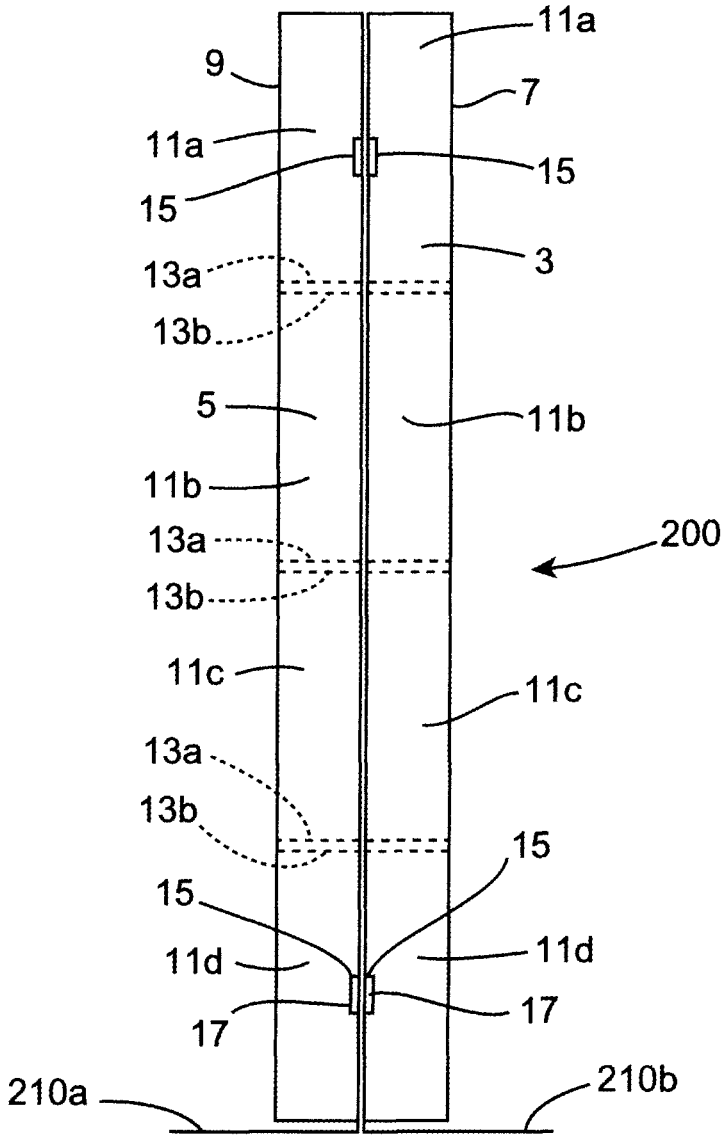
FIG. 17 is a side view of the display unit in FIG. 15.

Referring now to FIGS. 15 to 19, there is shown an alternative embodiment of the display unit in which like parts have been given the same reference numerals as before. Referring initially to FIGS. 15 to 17 there is shown a display unit indicated generally by the reference numeral 200 having a ground-engaging support 210 which protrudes slightly below the lowermost panels 11*d* of the elongate display sheets 3, 5. The ground engaging support 210 could however lie flush with the lowermost panels 11*d* of the elongate display sheets when in an operating position splayed outwardly. The ground-engaging support 210 is formed from two flat ground-engaging panels 210*a*, 210*b* each being substantially semi-circular in shape and having one straight edge and one arcuate edge. The ground-engaging panels 210*a*, 210*b* will rest on the ground, substantially orthogonal to the display unit 200. FIG. 16 shows the increased footprint of the display unit having the ground-engaging panels, giving rise to increased stability. The footprint will be substantially elliptical in shape, with the major axis of the ellipse defined by the straight edge of the ground-engaging panels and the minor axis of the ellipse defined by the depth of the ground-engaging support formed by the two ground-engaging panels.

Figure 18:
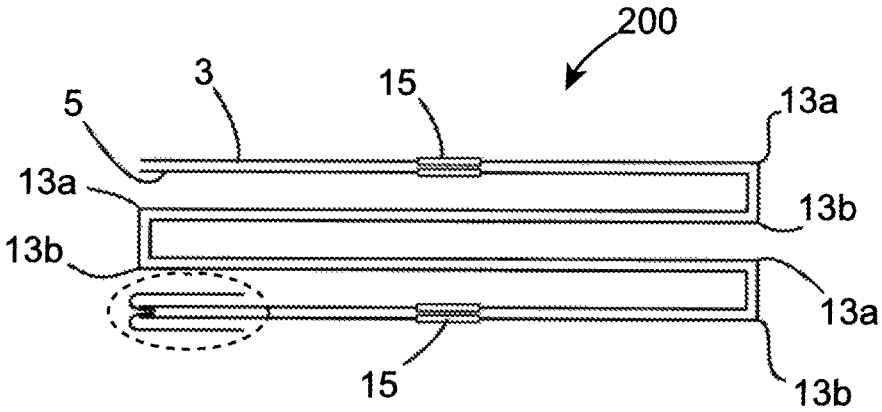
FIG. 18 is a diagrammatic side view representation of the display unit in FIG. 15 in a storage configuration.
Figure 19:
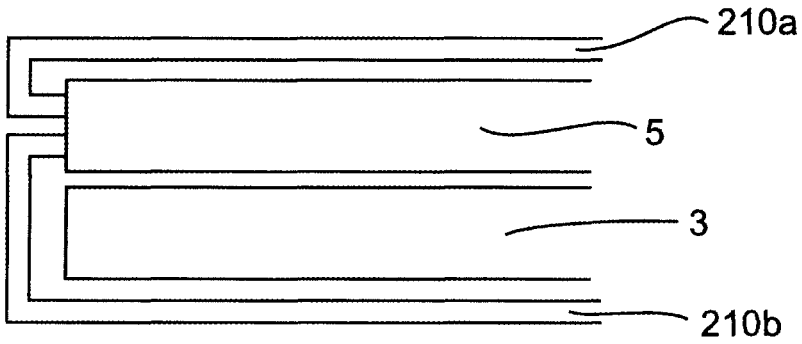
FIG. 19 is a detail of the circled section in FIG. 18.

Referring now to FIG. 18, there is shown a side view of the display unit 200 in a folded configuration. It can be seen that when folded the display unit 200 takes on a substantially serpentine shape, with the pairs of crease lines 13*a*, 13*b* defining the area where the display unit will fold. The display unit will fold through substantially 180° at each pair of crease lines 13*a*, 13*b* such that the panels 11*a*, 11*b*, 11*c*, 11*d* will lie substantially parallel to each other. Each ground-engaging panel 210*a*, 210*b* protrudes beyond the end of the lowermost panels of the display sheets 3, 5 and is folded 180° so that one ground-engaging panel 210*a* will lie along one display sheet 5 while the other ground-engaging panel 210*b* will lie along the other display sheet 3. A more detailed view of the circled area in FIG. 18 is shown in FIG. 19. For the sake of clarity FIG. 19 shows the side edges of the display sheets 3 and 5 slightly spaced apart however in reality they will abut each other. The two ground-engaging panels 210*a*, 210*b* protrude from the ends of the display sheets and are folded back so as to lie along the display faces 7, 9 of the display sheets 3, 5. The side edges of the display sheets 3, 5 shown in FIG. 19 correspond to the edges formed when the flaps 29 of the display sheet are folded over. As the ground-engaging panels 210*a*, 210*b* are attached to the bracing sheet 202 forming a unitary body and as the bracing sheet 202 will in general lie on one side of the two flaps, the ground-engaging panels are therefore shown protruding from the edge of one display sheet.

Figure 20:
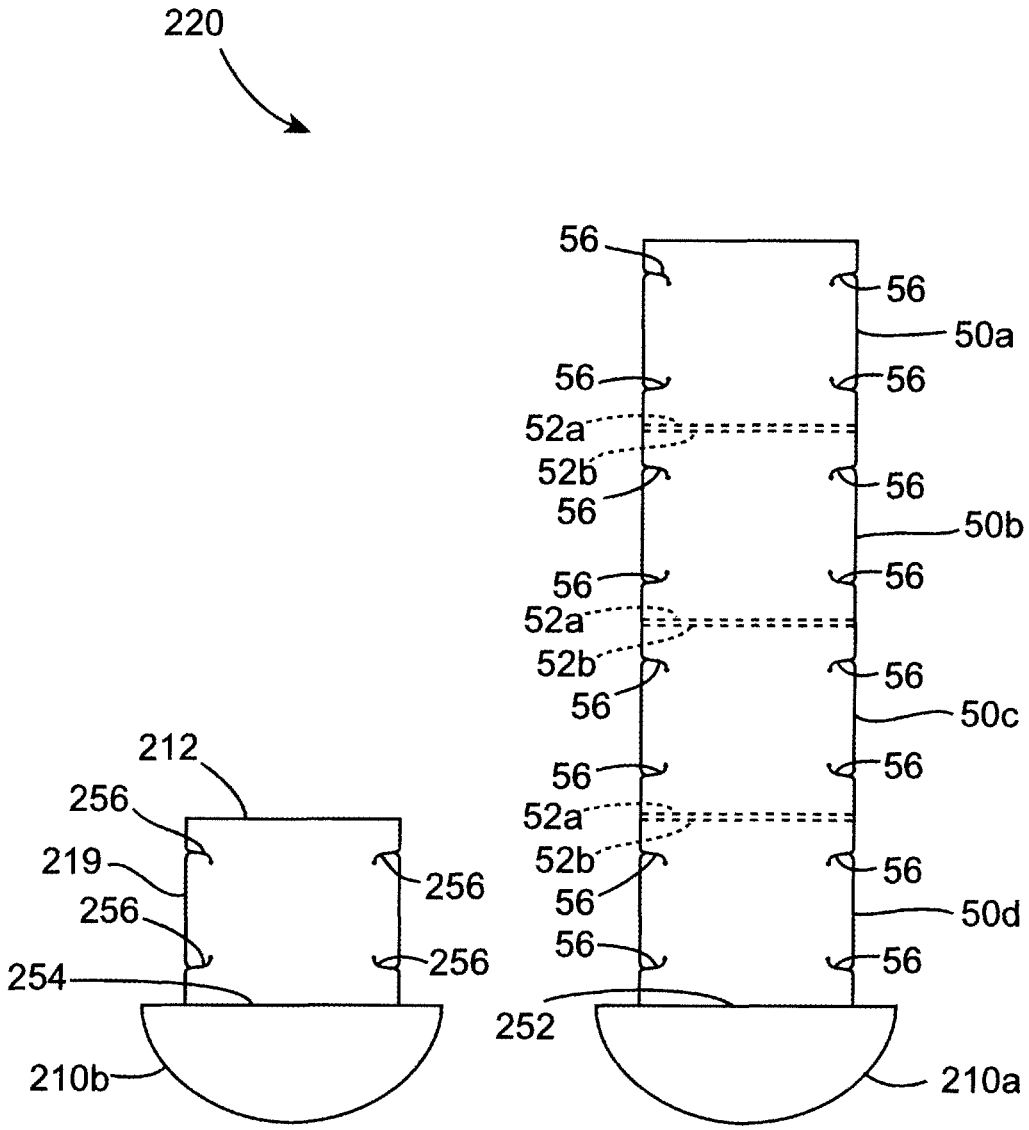
FIG. 20 is an exploded view of a bracing sheet used in the display unit of FIG. 15.

Referring now to FIG. 20 in which like parts have been given the same reference numerals as previously, there is shown the elongate bracing sheet 220, having four rectangular bracing panels 50*a*, 50*b*, 50*c*, 50*d* delimited by pairs of fold lines 52*a*, 52*b*. and a ground-engaging panel 210*a*, the bracing panels being delimited from each other by pairs of fold lines 52*a*, 52*b* and the ground-engaging panel 210*a* being delimited from the lowermost bracing panel 50*d* by a single fold line 252. The fold lines are formed during the manufacture of the display unit 1, and allow the substantially rigid material used to construct the display unit to fold easily at those lines. Each of the bracing panels 50*a*, 50*b*, 50*c*, 50*d* has a plurality of apertures 56 in their edges for connection to the display sheets by elastic bands (not shown). The bracing sheet 220 therefore comprises sixteen apertures. Each rectangular bracing panel 50*a*, 50*b*, 50*c*, 50*d* comprises four standard apertures 56, two in each side. The standard apertures 56 take the form of a thin cut in the material of the bracing sheet, the thin cut having a straight portion extending inwardly from the edge and substantially orthogonal thereto, and a curved portion extending from the straight portion. The standard aperture 56 then terminates in a substantially circular portion, in which the elastic band (not shown) will sit when fitted. For each of the rectangular bracing sheets 50*a*, 50*b*, 50*c*, 50*d*, on each side the curved portions of the two standard apertures 56 curve towards each other in that the upper aperture in a standard bracing panel curves downward and the lower aperture curves upwards. The lowermost bracing panel 50*d* of the bracing sheet 2 may comprise a pair of tabs (not shown), similar to the embodiments described above, for engagement with the slots 15 on the display sheets 3, 5. The lowermost bracing panel 50*d* of the bracing sheet 220 further mounts the ground-engaging panel 210*a* which corresponds in shape to a segment of a circle, wherein its chord defines the base of the lowermost bracing panel 50*d* and extends beyond the width of the bracing sheet 220.

Also shown in FIG. 20 is a complementary panel 212 comprising the ground-engaging panel 210*b*, which corresponds in shape and size to the ground-engaging panel 210*a* of the bracing sheet 220. The complementary panel 212 further comprises a rectangular additional bracing panel 219, delimited from the ground-engaging panel 210*b* by a fold line 254, wherein the chord of the ground-engaging panel 110*b* defines the base of the additional bracing panel 119 and the fold line 120. Furthermore the additional bracing panel 219 is the same width as the bracing panels 50*a*, 50*b*, 50*c*, 50*d* and comprises four standard apertures 256 positioned such that when the two ground-engaging panels 210*a*, 210*b* are arranged in line with each other, the standard apertures 256 of the additional bracing panel 219 will be co-located with the standard apertures 56 of the lowermost bracing panel 50*d* of the bracing sheet 220. Indeed, the additional bracing panel may be permanently affixed by glue or other means to the bracing sheet panel 50*d*.

To assemble the bracing sheet 220, the complementary panel 212 is secured to the bracing panel 50*d* such that the two ground-engaging panels 210*a*, 210*b* are arranged in line with each other and that four standard apertures 256 of the additional bracing panel 219 will be co-located with four standard apertures 56 of the lowermost bracing panel 50*d* of the bracing sheet 220. In this way an elongate unitary body is formed having four bracing panels and two ground-engaging panels 210*a*, 210*b*. In use, the bracing sheet 220 will form an inverted T-shape, with each ground-engaging panel 210*a*, 210*b* lying flat along the ground and the bracing panels standing upright and orthogonal to the ground-engaging panels.

Figure 21:
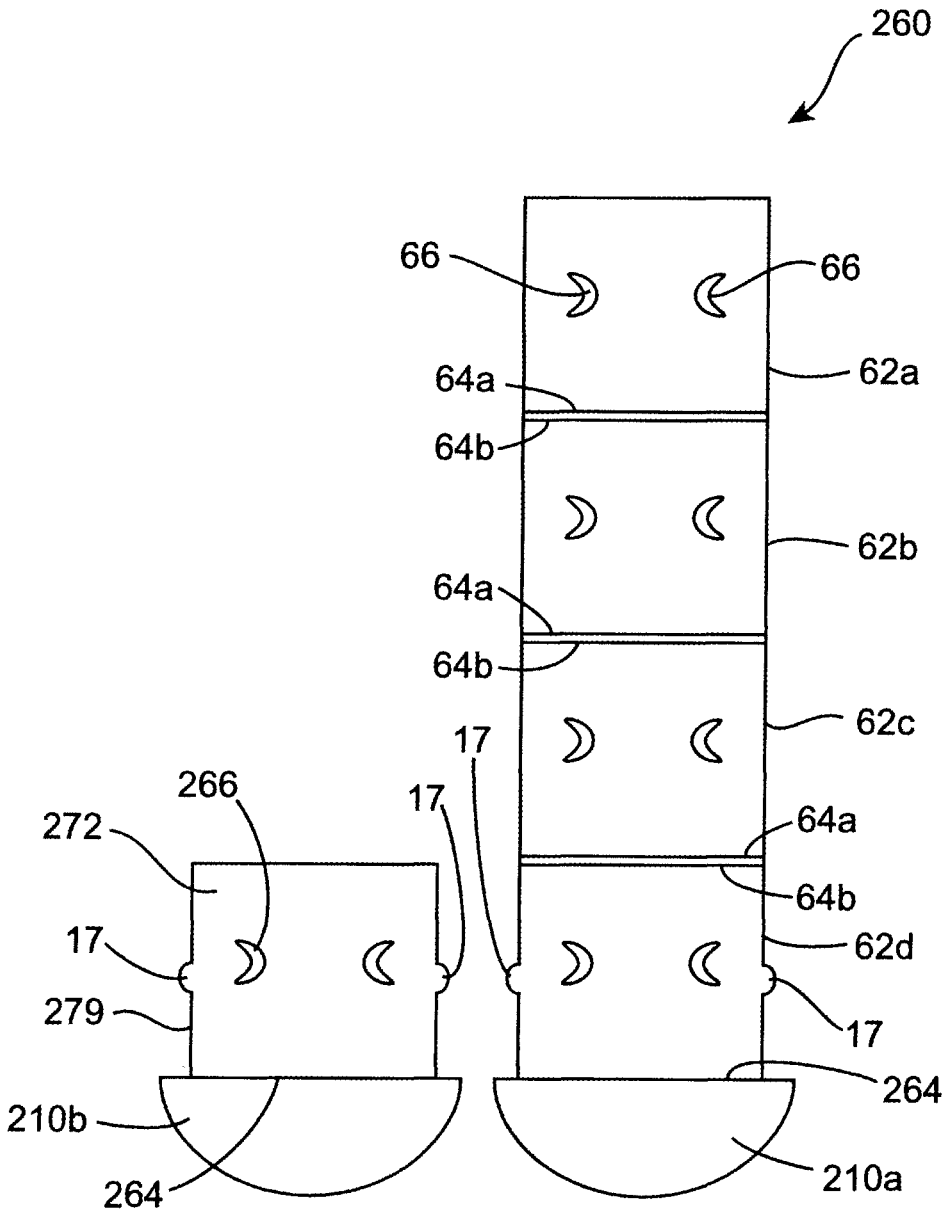
FIG. 21 is an exploded view of an alternative embodiment of bracing sheet to be used in the display unit of FIG. 15.

Referring now to FIG. 21 in which like parts have been given the same reference numerals as before, there is shown an elongate bracing sheet 260, having four bracing panels 62*a*, 62*b*, 62*c*, 62*d* and a ground-engaging panel 210*a*, the bracing panels being delimited from each other by pairs of fold lines 64*a*, 64*b* and the ground-engaging panel 210*a* being delimited from the lowermost bracing panel 62*d* by a single fold line 264. The fold lines are formed during the manufacture of the display unit 200, and allow the substantially rigid material used to construct the display unit to fold easily at those lines. Each of the bracing panels 62*a*, 62*b*, 62*c*, 62*d* has a pair of crescent-shaped cut-outs 66 for engagement with elastic bands (not shown) thereby allowing the bracing sheet 220 to be connected to the display sheets 3, 5. The points of the crescent-shaped cut-outs 66 face the edges of the bracing sheet 260 and effectively form notches for the reception of the elastic bands. The lowermost bracing panel 50*d* of the bracing sheet 260 has a pair of tabs 17 for engagement with the slots 15 on the display sheets 3, 5. In this instance, the tabs are substantially rectangular in shape. The lowermost bracing panel 50*d* of the bracing sheet 2 further mounts the ground-engaging panel 210*a* which corresponds in shape to a segment of a circle, wherein its chord defines the base of the lowermost bracing panel 19*d* and extends beyond the width of the bracing sheet 260.

Also shown in FIG. 21 is a complementary panel 272 comprising the ground-engaging panel 210*b*, which corresponds in shape and size to the ground-engaging panel 210*a* of the bracing sheet 260. The complementary panel 272 further comprises a rectangular additional bracing panel 279, delimited from the ground-engaging panel 210*b* by a crease line 280, wherein the chord of the ground-engaging panel 210*b* defines the base of the additional bracing panel 279 and the crease line 280. Furthermore the additional bracing panel 279 is the same width as the bracing panels 62*a*, 62*b*, 62*c*, 62*d* and comprises a pair of crescent shaped cut-outs 266 positioned such that when the two ground-engaging panels 210*a*, 210*b* are arranged in line with each other, the crescent shaped cut-outs 266 of the additional bracing panel 279 will be co-located with the crescent-shaped cut-outs 66 of the lowermost bracing panel 50*d* of the bracing sheet 260.

To assemble the bracing sheet 260, the complementary panel 272 is secured to the bracing panel 62*d* such that the two ground-engaging panels 210*a*, 210*b* are arranged in line with each other and that the crescent shaped cut-outs 266 of the additional bracing panel 279 will be co-located with the crescent-shaped cut-outs 66 of the lowermost bracing panel 62*d* of the bracing sheet 260. In this way an elongate unitary body is formed having four bracing panels and two ground-engaging panels 210*a*, 210*b*.

It will be understood that the embodiment of the display unit 200 described in relation to FIGS. 15 to 21 use the same display sheet as described in relation to FIGS. 1 to 7.

Figure 22:
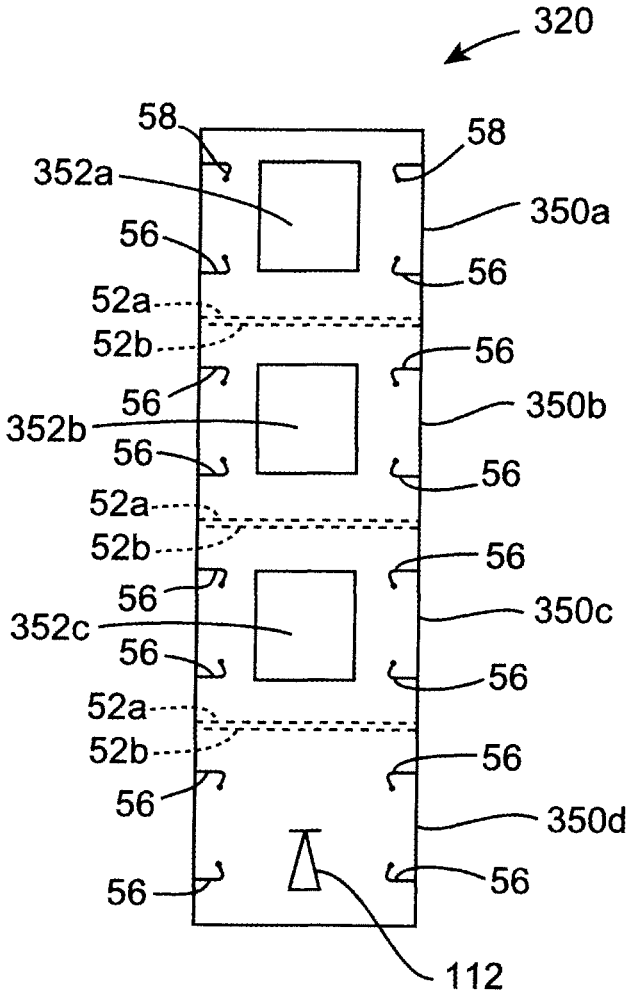
FIG. 22 is a front view of an alternative embodiment of bracing sheet.

Referring now to FIG. 22, in which like parts have been given the same reference numerals as before, there is shown a further embodiment of elongate bracing sheet indicated generally by the reference numeral 320. The elongate bracing sheet is substantially similar to that illustrated in FIG. 12 except that the uppermost bracing panel 350*a* is substantially rectangular in shape and is therefore substantially similar to the other bracing panels. Additionally, each of the upper three bracing panels 350*a*, 350*b*, 350*c* comprises a substantially rectangular cut-out 352*a*, 352*b*, 352*c* in the centre of the bracing panel. Such cutouts 352*a*, 352*b*, 352*c*, when combined with similar cut-outs in the display panels, allow inserts such as shelving units or display elements to be placed in the display unit 1, 100, 200. It will be noted that the use of such inserts is allowed by the use of a single bracing sheet having apertures 56 as described in relation to FIGS. 5, 12 and 20.

Figure 23:
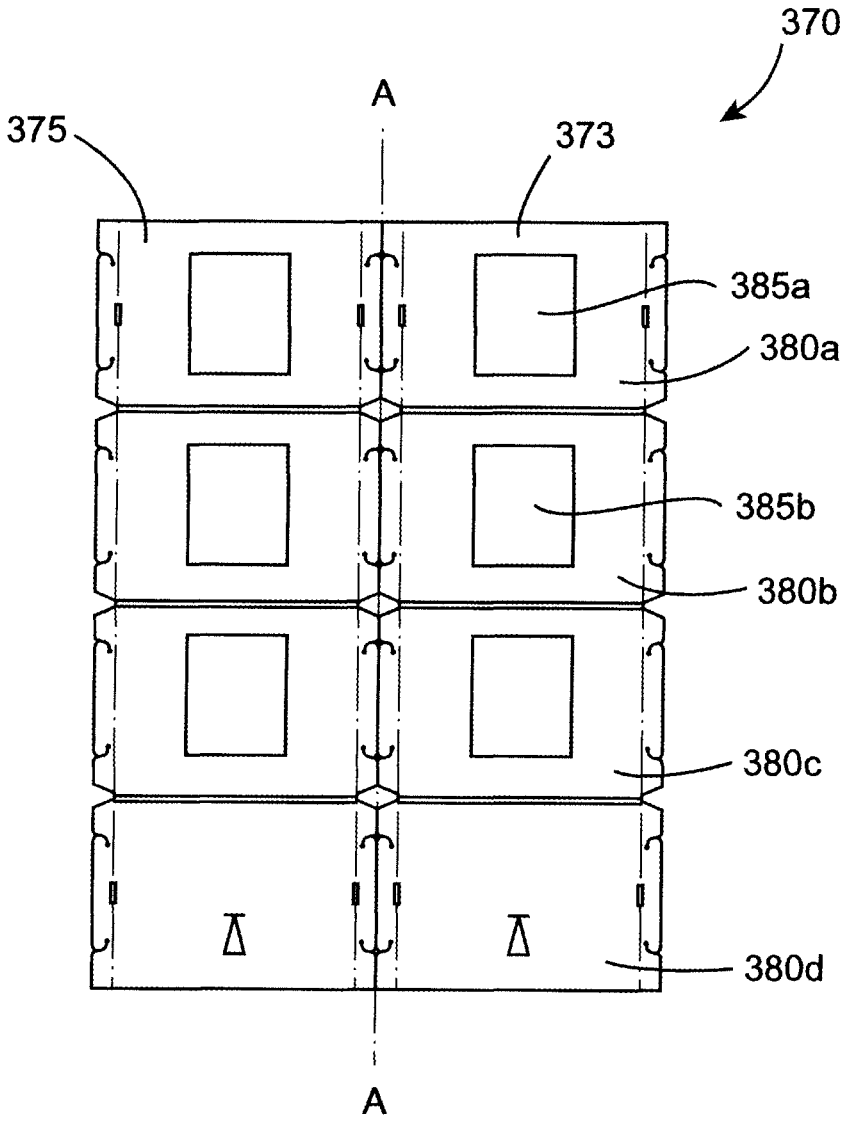
FIG. 23 is a front view of an alternative embodiment of self-expanding display unit.

Referring now to FIG. 23, there is shown an alternative embodiment of display sheet, indicated generally by the reference numeral 370. The display sheet 370 has a pair of display sheets 373, 375, for use with the bracing sheet 320 of FIG. 22. The display sheets 373, 375 are shown as one piece. However, the skilled person will understand that by cutting along the line A-A, two identical display sheets can be made. The display sheets are substantially similar to those described in relation to FIG. 6 except that each of the three uppermost panels 380*a*, 380*b*, 380*c*, 380*d* comprise substantially rectangular cut-outs 385*a*, 385*b*, 385*c* in the centre of the panel. This allows the insertion of various inserts which increase the functionality of the display unit.

It is envisaged that the arrangement of the bracing sheet 60, 160, 260 having crescent-shaped cut-outs 66, 266 located as described and shown in combination with the display sheets will provide a particularly effective self-expanding action for the display unit 1, 100, 200. It is envisaged that the display unit will expand with increased speed, ease and reliability.

It will be understood that the bracing sheet is formed from a material of greater stiffness than the display sheet. This provides greater stability to the display unit. Furthermore this ensures that the force exerted on the bracing sheet by the elastic securing means will not cause the bracing sheet to bend. Preferably, the bracing sheet is manufactured from a stiff card such as corrugated cardboard, while the display sheets are manufactured from the less stiff material such as paperboard.

Ideally, there will be provided a pair of display sheets, each having a display surface. The display sheets may be made from a single sheet of material bended in half or from two separate pieces of material and this will depend largely on the limitations of the cutting equipment and the size of sheet that the cutting equipment is able to handle. The display sheets will be mounted back to back thereby forming an ellipse in horizontal cross-section and the bracing sheet will be located intermediate the two sheets. It is envisaged that the width of the bracing sheet will be of the order of between 70% and 90% of the width of the display sheet (that is, the width of the display face visible when in normal use and excluding any flaps 29 along the edges of the display face). Preferably, the width of the bracing sheet will be of the order of between 80% and 90% of the width of the display sheet. Ideally, the width of the bracing sheet will be of the order of between 82% and 88% of the width of the display sheet. Furthermore, the height of the bracing sheet at it maximum extension will be of the order of between 85% and 100% of the height of the display sheet. Preferably, the height of the bracing sheet will be of the order of between 90% and 100% of the height of the display sheet. Ideally, the height of the bracing sheet will be of the order of between 92% and 98% of the height of the display sheet. Typically, the display may be provided in a variety of sizes with different widths and heights to suit the individual needs. However, the display as shown in FIGS. 1 to 7 has a display face with a height of the order of 153 cm and a display face width (when flat in a stored configuration) of 50 cm. The bracing sheets 2, 60 have a height at the edges (the common maximum point) of 145 cm and a maximum width (excluding the tabs 17) of 42 cm. The flaps 29 have a width of the order of 4.5 cm.

The presence of slots in both endmost panels of the display sheets makes the display sheets symmetrical. In other words, either end panel may be the top panel or the bottom panel and therefore the orientation of the panels relative to the bracing sheets during assembly is irrelevant. This reduces the complexity of the assembly process as it is not necessary to ensure that the display sheets are the right way up before commencing assembly. It will be understood that by altering the width of the bracing sheets relative to the display sheets, the curvature of the display sheets when the display unit is in use can also be altered.

Throughout the specification, the term elastic and elasticated has been used in reference to elements that return to their original shape or configuration after they have been deformed. It will be understood by the person skilled in the art that elements other than elastic bands could be used for this purpose. These elements could include springs and other resilient components.

In the specification the terms comprise, comprises, comprised and comprising or any variation thereof and the terms include, includes, included or including or any variation thereof are considered to be totally interchangeable and they should all be afforded the widest possible interpretation.

The invention is not limited to the embodiment herein described, but may be varied in both construction and detail within the terms of the claims.

The invention claimed is:

1. A self-expanding display unit comprising at least one display sheet of a substantially rigid and foldable material, the display sheet having a display face and the display sheet comprising a plurality of panels, delimited from adjacent panels by crease lines, the display unit further comprising a biasing means for bending the display face of the display sheet into a substantially convex shape, the biasing means comprising one or more resiliently extensible members, and bracing means acting against the biasing means to limit the amount by which the display sheet bends, wherein the bracing means comprises a single, substantially rigid and foldable bracing sheet that is separate from the display sheet and having a plurality of bracing panels, each of which is delimited from an adjacent bracing panel by a fold line, the bracing sheet being positioned relative to the display sheet such that each fold line of the bracing sheet is coincident with a crease line of the display sheet; the display sheet and the bracing sheet being foldable together at their crease lines and fold lines respectively, wherein the bracing sheet has a tab along one side edge thereof for engagement with a complimentary slot formed in the display sheet to limit relative movement therebetween, and wherein the display sheet includes one or more notches from the outside edge of the display sheet to allow a connection of the display sheet with the bracing sheet.

2. A self-expanding display unit as claimed in claim 1 in which the bracing sheet has an upper end, a lower end and two side edges, the lower end of the bracing sheet being coincident with a lower end of the display sheet such that the lower end of the bracing sheet and the lower end of the display sheet each form a ground-engaging support for the display unit.

3. A self-expanding display unit as claimed in claim 1 in which each bracing panel of the bracing sheet comprises at least one aperture for connecting the biasing means to the bracing sheet.

4. A self-expanding display unit as claimed in claim 3 in which each bracing panel of the bracing sheet comprises a plurality of apertures located at the side edges of the bracing sheet for connecting the biasing means to the bracing sheet.

5. A self-expanding display unit as claimed in claim 4 in which the apertures comprise a narrow cut extending inwardly from an edge of the sheet and terminating in a circular aperture.

6. A self-expanding display unit as claimed in claim 3 in which each bracing panel of the bracing sheet comprises a pair of crescent-shaped apertures for connecting the biasing means to the bracing sheet.

7. A self-expanding display unit as claimed in claim 1 in which the bracing sheet comprises a further panel, forming a ground-engaging panel, which extends from the lower end of the bracing sheet and is delimited from the bracing panel adjacent the lower end of the bracing panel by a fold line.

8. A self-expanding display unit as claimed in claim 7 in which the ground engaging panel is substantially semi-elliptical in shape.

9. A self-expanding display unit as claimed in claim 7 in which the ground-engaging panel is wider than the bracing sheet.

10. A self-expanding display unit as claimed in claim 7 in which the ground-engaging panel is substantially the same width as the display face when in a storage configuration.

11. A self-expanding display unit as claimed in claim 7 in which the bracing sheet comprises a pair of ground-engaging panels, both of which extend from the lower end of the bracing sheet.

12. A self-expanding display unit as claimed in claim 1 in which the area of the bracing panel adjacent the upper end of the bracing sheet is less than that of the other bracing panels of the bracing sheet.

13. A self-expanding display unit as claimed in claim 1 in which each panel of the display sheet is delimited from an adjacent panel by a pair of spaced-apart substantially parallel crease lines.

14. A self-expanding display unit as claimed in claim 1 in which each panel of the bracing sheet is delimited from an adjacent panel by a pair of spaced-apart substantially parallel fold lines.

15. A self-expanding display unit as claimed in claim 1 in which the display face has at least two edges, substantially vertical in use, and the slots are formed therein.

16. A self-expanding display unit as claimed in claim 15 in which there are two pairs of slots, one pair adjacent an upper end of the display sheet and the other pair adjacent the lower end of the display sheet.

17. A self-expanding display unit as claimed as claimed in claim 1 in which there are provided a pair of display sheets each having a display face and a plurality of panels delimited from an adjacent panel by crease lines, the display sheets being connected together adjacent the side edges thereof with their display faces back-to-back, the display sheets thereby, in use, forming a structure substantially elliptical in horizontal cross-section, the crease lines of the first display sheet being coincident with the crease lines of the second display sheet.

18. A self-expanding display unit comprising at least one display sheet of a substantially rigid and foldable material, the display sheet having a display face and the display sheet comprising a plurality of panels, delimited from adjacent panels by crease lines, the display unit further comprising a biasing means for bending the display face of the display sheet into a substantially convex shape, the biasing means comprising one or more resiliently extensible members, and bracing means acting against the biasing means to limit the amount by which the display sheet bends, wherein the bracing means comprises a single, substantially rigid and foldable bracing sheet that is separate from the display sheet and having a plurality of bracing panels, each of which is delimited from an adjacent bracing panel by a fold line, the bracing sheet being positioned relative to the display sheet such that each fold line of the bracing sheet is coincident with a crease line of the display sheet; the display sheet and the bracing sheet being foldable together at their crease lines and fold lines respectively and in which the bracing sheet has an upper end, a lower end and two side edges, the lower end of the bracing sheet being coincident with a lower end of the display sheet such that the lower end of the bracing sheet and the lower end of the display sheet each form a ground-engaging support for the display unit, wherein the bracing sheet has a tab along one side edge thereof for engagement with a complimentary slot formed in the display sheet to limit relative movement therebetween, and wherein the display sheet includes one or more notches from the outside edge of the display sheet to allow a connection of the display sheet with the bracing sheet.

19. A self-expanding display unit as claimed in claim 18 in which each bracing panel of the bracing sheet comprises at least one aperture for connecting the biasing means to the bracing sheet.

20. A self-expanding display unit as claimed in claim 18 in which each bracing panel of the bracing sheet comprises a plurality of apertures located at the side edges of the bracing sheet for connecting the biasing means to the bracing sheet.

21. A self-expanding display unit as claimed in claim 18 in which each bracing panel of the bracing sheet comprises a pair of crescent-shaped apertures for connecting the biasing means to the bracing sheet.

22. A self-expanding display unit comprising a pair of display sheets of a substantially rigid and foldable material, each display sheet having a display face and comprising a plurality of panels, delimited from adjacent panels by crease lines, wherein the crease lines of one display sheet are coincident with the crease lines of the other display sheet, the display unit further comprising a biasing means for bending the display faces of the display sheets into a substantially convex shape, the biasing means comprising one or more resiliently extensible members; and bracing means acting against the biasing means to limit the amount by which the display sheets bend, wherein the bracing means comprises a single, substantially rigid and foldable bracing sheet that is separate from the display sheet and having a plurality of bracing panels, each of which is delimited from an adjacent bracing panel by a fold line, the bracing sheet being positioned relative to the display sheets such that each fold line of the bracing sheet is coincident with a crease line of the display sheets; the display sheets and the bracing sheet being foldable together at their crease lines and fold lines respectively; and wherein the display sheets are connected together adjacent the side edges thereof with their display faces back-to-back, the display sheets thereby, in use, forming a structure substantially elliptical in horizontal cross-section, wherein the bracing sheet has a tab along one side edge thereof for engagement with a complimentary slot formed in the display sheet to limit relative movement therebetween, and wherein the display sheet includes one or more notches from the outside edge of the display sheet to allow a connection of the display sheet with the bracing sheet.

23. A self-expanding display unit as claimed in claim 22 in which each bracing panel of the bracing sheet comprises at least one aperture for connecting the biasing means to the bracing sheet.

24. A self-expanding display unit as claimed in claim 22 in which each bracing panel of the bracing sheet comprises a plurality of apertures located at the side edges of the bracing sheet for connecting the biasing means to the bracing sheet.

25. A self-expanding display unit as claimed in claim 22 in which each bracing panel of the bracing sheet comprises a pair of crescent-shaped apertures for connecting the biasing means to the bracing sheet.

* * * * *